United States Patent [19]

Pye et al.

[11] Patent Number: 4,498,543

[45] Date of Patent: Feb. 12, 1985

[54] METHOD FOR PLACING A LINER IN A PRESSURIZED WELL

[75] Inventors: David S. Pye, Indio; Donald L. Ash; Robert W. Rardin, both of Santa Rosa, all of Calif.

[73] Assignee: Union Oil Company of California, Los Angeles, Calif.

[21] Appl. No.: 488,105

[22] Filed: Apr. 25, 1983

[51] Int. Cl.[3] ..... E21B 43/10

[52] U.S. Cl. ..... 166/376; 166/278

[58] Field of Search ..... 466/376, 373, 317, 278, 466/276, 205; 137/68 R

[56] References Cited

U.S. PATENT DOCUMENTS

| | | | |
|---|---|---|---|
| 958,100 | 5/1910 | Decker | 166/205 |
| 2,201,290 | 5/1940 | Greene | 166/317 X |
| 2,913,051 | 11/1959 | Lister | 166/227 X |
| 2,952,318 | 9/1960 | Ritch | 166/278 |
| 3,216,497 | 11/1965 | Howard et al. | 166/376 X |
| 3,333,635 | 8/1967 | Crawford | 166/276 |

*Primary Examiner*—Stephen J. Novosad

*Assistant Examiner*—Thuy M. Bui

*Attorney, Agent, or Firm*—Dean Sandford; Gregory F. Wirzbicki; Gerald L. Floyd

[57] ABSTRACT

A method for placing a perforated liner in a well penetrating a reservoir containing a high pressure fluid, for example, a geothermal fluid. The holes in one or more sections of a preperforated liner are temporarily closed by inserting therein hollow plugs having an open flange end at the outer surface of the liner and a closed end projecting into the bore of the liner. The lower end of a first section of liner is also closed as with a solid plug. The liner, made up of one or more of the above-described sections which have been joined together, is run into the well through a pressure sealing device at the wellhead, such as a stripper rubber or rotating head. When the liner has been properly positioned in the well, a cutting or scraping tool is run down the inside of the liner to remove the closed end of each plug projecting into the liner, thus opening the perforations in the liner. Reservoir fluids can be produced through the well around the outside of the liner while the liner is being placed.

12 Claims, 2 Drawing Figures

METHOD FOR PLACING A LINER IN A PRESSURIZED WELL

BACKGROUND OF THE INVENTION

1. Field of the Invention

This invention relates to a method for placing a perforated liner in a fluid pressurized well, such as a geothermal well. More particularly, the invention relates to such a method involving producing fluids via the well around the outside of the liner while the liner is being placed in the well.

2. Description of the Prior Art

Among the many types of downhole well completions is one in which a preperforated liner or screen is positioned opposite the reservoir interval over which it is desired either to produce fluid or to inject fluid. The liner may be made part of the casing and either left sitting unsupported in the open hole, or the annular space between the wellbore sidewall and the outside of the liner can be filled with a permeable material, such as a gravel pack. Liners can be especially useful where the wellbore sidewall material is poorly consolidated or contains or is composed of shale, clays, silicates and the like and the produced or injected fluids contain or are composed of liquid water. Without a liner being positioned in the wellbore, the shale and other materials tend to swell in the presence of water and slough into the open hole, often leading to collapse of the entire hole. The liner also decreases the amount of formation particles produced along with formation fluids.

Difficulties have been experienced in running preperforated liners into wells, especially wells penetrating reservoirs containing high pressure fluids, more particularly high temperature geothermal fluids and most particularly dry geothermal steam wells. When attempts have been made to run a preperforated liner into such wells, the high pressure formation fluids quickly pass through the perforations and up the liner to the surface where they escape, resulting in considerable danger to the workmen running the liner.

It has been the practice in the past to first inject into the well a fluid, such as water, in sufficient volume to provide a hydrostatic head to counterbalance the formation pressure and "kill" the well. The perforated liner can then be safely run into the well and the injected water subsequently removed. However, this manner of killing the well has not been satisfactory since the reason for running the liner in the first place is that the wellbore may contain shale or similar unstable materials. These materials can swell and collapse into the open hole as soon as contacted by the injected water. Thus, the wellbore becomes restricted with detritus and the liner cannot be lowered into place.

In certain well operations, such as in cementing casing, it is known to run into a well perforated liner whose openings have been filled with plugs, and to later run a cutting tool down the liner to remove the plugs and open the openings in the liner. However, it has not been the practice to employ plugs designed to withstand a differential pressure wherein the pressure on the outside of the liner is considerably greater than the pressure on the inside of the liner.

While the above-described well treating methods have met with some success in particular applications, the need exists for a further improved method for placing a perforated liner in a well.

Therefore, it is a principal object of this invention to provide a method for placing a preperforated liner safely in a fluid pressurized well.

It is a further object to provide such a method operable in wells producing a geothermal fluid.

It is a still further object to provide such a method wherein the well produces dry steam.

It is another object to provide such a method wherein the well is produced while the liner is being placed.

Other objects, advantages and features of this invention will become apparent to those skilled in the art from the following description, drawings and appended claims.

SUMMARY OF THE INVENTION

Briefly, the invention provides a method for placing a preperforated liner in a well penetrating a reservoir containing a high pressure fluid comprising;

(a) inserting plugs into the holes in the sidewall of a section of preperforated liner having a closed bottom end, said plugs being sized to fit fluid-tightly into the openings in the liner and having a flange or shoulder portion on one end adapted to fit tightly against the outside of the liner around the opening, a hollow shank portion running through the opening and a hollow head portion protruding into the interior of the liner, (b) running a section of the plug-containing preperforated liner, or two or more serially connected such sections, into the well through a pressure seal at the surface, said liner being part of a casing string, (c) positioning the liner approximately opposite the reservoir containing the high pressure fluid, (d) running a cutting or scraping tool down the liner to remove the heads of the plugs and open the openings in the liner, and (e) utilizing the well for injection or production of fluids through the liner.

Optionally, fluids can be produced through the well around the outside of the liner while the liner is being introduced therein.

DETAILED DESCRIPTION OF THE INVENTION

In running a preperforated liner as part of a string of casing into a well, which well penetrates a reservoir containing a high pressure fluid such as oil, natural gas, water or steam, the reservoir fluids tend to pass into the well, through the openings in the liner, up the inside of the casing and escape to the atmosphere at the surface where the workmen are making up the string of casing. This fluid, which may be either a liquid or gas, is at the very least a nuisance and a contaminant to the environment, as well as a hazard to the workmen. This invention involves a method for running such a liner without first having to inject into the well a fluid to counterbalance the wellbore pressure, an operation which can damage the permeability of reservoirs sensitive to foreign fluids.

Figure 1:
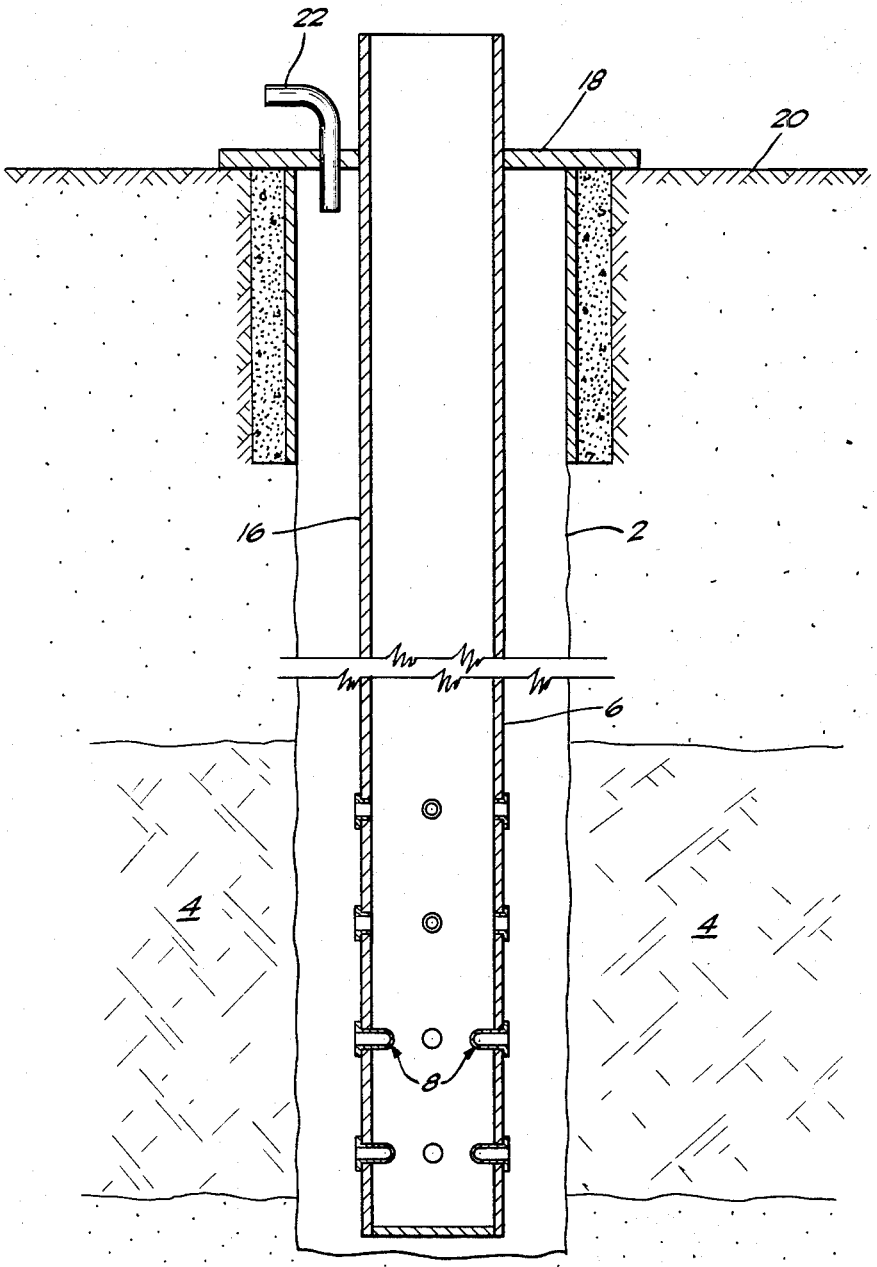
FIG. 1 is a vertical cross-sectional view schematically illustrating a well in which a liner has been run.
Figure 2:
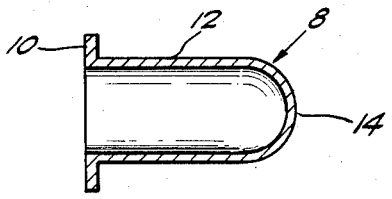
FIG. 2 is a cross-sectional view of a hollow plug for use in the liner of FIG. 1.

Referring now to FIG. 1, well 2 penetrates high pressure fluid containing-reservoir 4. The openings in perforated liner 6 are filled with hollow plugs 8. As can be seen more clearly in FIG. 2, each hollow plug 8 is made up of shoulder ring 10 adapted to fit tightly around an opening in liner 6, hollow shank portion 12 which runs through the opening in liner 6, and hollow head portion 14 which protrudes into the interior of liner 6. In carrying out the method of this invention, liner 6 containing plugged openings is run into well 2 as part of casing string 16 through pressure seal 18 at the surface 20. When liner 6 has been positioned opposite reservoir 4, a cutting or scraping tool (not shown) is run down the interior of liner 6 to shear heads 14 off hollow plugs 8. As shown in FIG. 1, the two top rows of plugs 8 have had their heads 14 sheared off while the bottom two rows of plugs 8 are intact. In actual practice, the heads of all plugs 8 would probably be removed during a single run of the cutting tool.

Under some circumstances, such as when it is desired to maintain dynamic flow conditions around well 2, fluids from reservoir 4 can be produced up the annular space around liner 6 while liner 6 is being run. Such reservoir fluids can be withdrawn at surface 20 by way of pipe 22 to a point of further utilization (not shown).

The plugs can be made of any solid material. Particularly suitable are materials which are capable of withstanding considerable fluid pressure differential, yet can be rather easily cut or broken. Examples of suitable materials include steel, cast iron, aluminum alloys, brass and plastics.

The invention is further illustrated by the following example which is illustrative of various aspects of the invention and is not intended as limiting the scope of the invention as defined by the appended claims.

EXAMPLE

It is desired to place a perforated liner in a geothermal well producing about 50,000 pounds per hour dry steam. The well is equipped with $9\frac{5}{8}$ inch diameter, 40 pound K55 casing cemented to a depth of 2,300 feet. An $8\frac{3}{4}$ inch diameter open hole is drilled through the producing interval, i.e., from 2,300 feet to a total depth of 4,439 feet. The liner is made up as part of a string of 40 foot long, 7-inch diameter sections of 26 pound K55 casing. The casing string comprises alternate sections of blank casing and casing sections preperforated by drilling $\frac{1}{2}$ inch diameter holes in the casing string, said holes being drilled in rows along the length of the casing, 10 holes per row, the holes being spaced on centers 3 inches apart vertically. There is driven into each hole a hollow bullet-shaped aluminum alloy plug so that the flange of the plug fits against the outside of the liner around the hole in fluid-tight engagement, and the nose of the plug projects into the inside of the liner approximately one inch. While steam is being produced from the well, the 7-inch diameter casing string containing the plugged liner is run into the hole through a rotating head. There is then run into the well and down the casing a scraper with blades to remove the heads of the plugs in the openings of the liner. This opens fluid communication between the reservoir and the interior of the 7-inch diameter casing string. The scraper is then removed from the hole. This production well is then converted into an injection well for reinjection of fluids back into the reservoir. There is no problem of plugging the well due to collapse of the open hole when fluid injection takes place.

While various specific embodiments and modifications of this invention have been described in the foregoing specification, further modifications will be apparent to those skilled in the art. Such further modifications are included within the scope of the invention as defined by the following claims:

We claim:

1. A method for placing a perforated liner in a well penetrating a reservior containing a high pressure fluid comprising:

(a) inserting, into openings in the sidewall of the liner, solid hollow plugs capable of withstanding a pressure differential wherein the pressure on the outside of the liner is greater than the pressure on the inside of the liner, said plugs each having a head end protruding into the interior of the liner and a flange portion in contact with the exterior of the liner;

(b) running the plug-containing liner into the well; and (c) running a cutting or scraping tool down the inside of the liner to remove the heads of the plugs and open the openings in the liner.

2. The method defined in claim 1 wherein fluid is produced from the reservior via the well around the outside of the liner while the liner is being run into the well.

3. The method defined in claim 1 wherein the well is a geothermal fluid producing well.

4. The method defined in claim 3 wherein the geothermal fluid is dry steam.

5. The method defined in claim 1 wherein the cutting or scraping tool is removed from the liner after the heads of the plugs have been removed.

6. The method defined in claim 1 wherein the plug-containing liner is run into the well through a pressure seal at the surface.

7. A method for converting a dry steam-producing geothermal well into an injection well for liquid comprising:

(a) inserting into the openings in the sidewall of a preperforated liner solid hollow plugs having a hollow shank portion extending through the opening, a flange end adapted to fit in fluid tight engagement against the exterior of the liner around the opening and a hollow head portion protruding into the interior of the liner, (b) running the resulting plug-containing liner into the well, (c) running a cutting or scraping tool down the inside of the liner to remove the heads of the plugs and open the openings in the liner, and (d) injecting liquid down the well, through the liner and into the reservoir.

8. The method defined in claim 7 wherein dry steam is produced from the well around the outside of the liner during step (b).

9. The method defined in claim 7 wherein the cutting or scraping tool is removed from the liner after the heads of the plugs have been removed.

10. The method defined in claim 7 wherein the plug-containing liner is run into the well through a pressure seal at the surface.

11. The method defined in claim 7 wherein the liquid injected in step (d) is a geothermal brine.

12. A method for placing a perforated liner in a well penetrating a reservior which contains a high pressure fluid, comprising:

(a) inserting, into perforations in the sidewall of the liner, closed hollow plugs, said plugs each having a head end protruding into the interior of the liner and a flange portion in contact with the exterior of the liner;

(b) running the plug-containing liner into the well; and (c) opening the perforations in the liner.

* * * * *